United States Patent [19]

Mitsuo

[11] Patent Number: 4,631,204

[45] Date of Patent: Dec. 23, 1986

[54] PROCESS OF PRODUCING COLOR DEVELOPER SHEET FOR PRESSURE-SENSITIVE RECORDING

[75] Inventor: Hirofumi Mitsuo, Shizuoka, Japan

[73] Assignee: Fuji Photo Film Co., Ltd., Kanagawa, Japan

[21] Appl. No.: 608,833

[22] Filed: May 10, 1984

[30] Foreign Application Priority Data

May 10, 1983 [JP] Japan ..... 58-81524

[51] Int. Cl.[4] ..... B41M 5/22

[52] U.S. Cl. ..... 427/150; 346/210; 346/211; 346/212; 346/213; 346/216; 427/151

[58] Field of Search ..... 346/210, 211, 212, 213, 346/216, 225, 214, 217; 427/150, 151, 152

[56] References Cited

U.S. PATENT DOCUMENTS 4,138,522 2/1979 Ishizuka et al. ..... 346/213
4,262,936 4/1981 Miyamoto ..... 346/212
4,263,047 4/1981 Miyamoto et al. ..... 346/216
4,321,093 3/1982 Seitz ..... 346/213
4,372,583 2/1983 Vassiliades ..... 346/212

FOREIGN PATENT DOCUMENTS 0136483 8/1983 Japan ..... 346/213

*Primary Examiner*—Bruce H. Hess
*Attorney, Agent, or Firm*—Sughrue, Mion, Zinn, Macpeak, and Seas

[57] ABSTRACT

A process for producing a color developer sheet for pressure-sensitive recording comprising mixing a coating liquid containing a metal salt of an aromatic carboxylic acid and an aqueous emulsion of an organic solvent and coating the resulting mixture on a support, wherein the organic solvent has a boiling point of about 150° C. to about 315° C. and dissolves the metal salt of the aromatic carboxylic acid in such an amount that the metal salt of the aromatic carboxylic acid has a solubility in the organic solvent of 10 or more at 25° C.

12 Claims, No Drawings

PROCESS OF PRODUCING COLOR DEVELOPER SHEET FOR PRESSURE-SENSITIVE RECORDING

FIELD OF THE INVENTION

This invention relates to a process of producing a color developer sheet for pressure-sensitive recording and, more particularly, to a color developer sheet for pressure-sensitive recording coated with or containing a color developer which is an adsorptive or reactive compound capable of coloration upon contact with a colorless or almost colorless color former.

BACKGROUND OF THE INVENTION

Pressure-sensitive recording materials utilizing the coloring reaction of a color former, which is a material forming a color on donating an electron or accepting a proton such as an acid, and a color developer which is a material accepting an electron or donating a proton are well known as described in, for example, U.S. Pat. Nos. 2,505,470, 2,505,489, 2,550,471, 2,548,366, 2,712,507, 2,730,456, 2,730,457, and 3,418,250, Japanese Patent Publication (Unexamined) Nos. 28411/74, 44009/75, etc. Exemplary color developers which are used for this purpose are clay materials such as acid clay, active clay, attapulgite, zeolite, bentonite, kaolin, etc.; metal salts of aromatic carboxylic acids; phenol-formaldehyde resins, etc.

Furthermore, a printing method of obtaining a colored image by supplying an ink containing a color former or color formers onto a sheet coated with a color developer is well known (e.g., as described in West German Patent Application (OLS) No. 1,939,962).

As described above, various color developers for pressure-sensitive recording materials are known.

However, the use of clays, which are most generally used as color developers for pressure-sensitive recording materials at present, such as acitve clay, acid clay, etc., has the disadvantages that the colored images formed have poor light resistance and water resistance and also lack good stability with the lapse of time. Also, the use of phenol resins has the disadvantages that the developing power is low and the color developer causes yellowing.

The metal salts of aromatic carboxylic acids are known as a color developer without such disadvantages. A color developer sheet using a metal salt of an aromatic carboxylic acid is prepared by coating a support with an aqueous dispersion containing the color developer together with an inorganic pigment, a binder, a dispersing agent, and other additives. However, the color developer sheet obtained in the manner as described above is yet insufficient in coloring speed and developing power and the coating sheet has a coating unevenness caused by the marked formation of bubbles in the aqueous dispersion.

SUMMARY OF THE INVENTION

A first object of this invention is, therefore, to provide a process for producing a color developer sheet for pressure-sensitive recording with improved coloring speed.

A second object of this invention is to provide a process for producing a color developer sheet for pressure-sensitive recording having improved developing power.

A third object of this invention is to restrain the foaming property of the aqueous dispersion for producing color developer sheets to provide a color developer sheet for pressure-sensitive recording without coating unevenness.

The above-described objects of this invention are attained by the process of this invention. That is, this invention provides a process for producing a color developer sheet for pressure-sensitive recording comprising mixing a coating liquid containing a metal salt of an aromatic carboxylic acid with an aqueous emulsion of an organic solvent, and coating the resulting mixture on a support, wherein the organic solvent has a boiling point of about 150° C. to about 315° C. and can dissolve the metal salt of the aromatic carboxylic acid in such an amount that the metal salt of the aromatic carboxylic acid has a solubility in the organic solvent of about 10 or more at 25° C. The solubility of the metal salt of the aromatic carboxylic acid herein means the total amount (gram number) of the metal salt of the aromatic carboxylic acid dissolved in 100 g of the organic solvent at 25° C.

DETAILED DESCRIPTION OF THE INVENTION

If an organic solvent having a boiling point lower than about 150° C. is used in the process of this invention, the solvent markedly evaporates reducing the workability of the process and coloring property of the color developer sheet thus produced, while if an organic solvent having a boiling point higher than about 315° C. is used, the organic solvent is difficult to evaporate off in the coating step and remains in the coated paper, which results in reducing the durability of the colored images. Also, if the metal salt of the aromatic carboxylic acid is dissolved by the organic solvent at less than 10 (calculated as solubility), sufficient coloring speed is not obtained.

The metal salts of aromatic carboxylic acids described in, for example, U.S. Pat. Nos. 3,864,146 and 3,983,292 and Japanese Patent Application No. 25158/78, etc., are preferably used in this invention.

Suitable aromatic carboxylic acids for the above-described aromatic carboxylic acid metal salts include aromatic carboxylic acids each having a hydroxy group at the ortho position or the para position to the carboxy group. Of these carboxylic acids, salicylic acid derivatives are more preferred and of these derivatives, salicylic acid derivatives each having a substituent such as an alkyl group, an aryl group, an aralkyl group, etc., at at least one of the ortho position and the para position to the hydroxy group, where the total number of carbon atoms in the substituent being 8 or more are particularly preferred.

Specific examples of particularly preferred aromatic carboxylic acids are 3,5-di-t-butylsalicylic acid, 3,5-di-t-amylsalicylic acid, 3,5-bis(α,α-dimethylbenzyl)salicylic acid, 3,5-bis(α-methylbenzyl)salicylic acid, 3-(α-methylbenzyl)-5-(α,α-dimethylbenzyl)salicylic acid, 3,5-di-t-octylsalicylic acid, 3-cyclohexyl-5-(α,α-dimethylbenzyl)salicylic acid, etc.

Suitable metals forming the metal salts with the above-described aromatic carboxylic acids are magnesium, aluminum, calcium, nickel, copper, zinc, tin, lead, etc. Of these metals, zinc is most effective.

The above-described metal salts of aromatic carboxylic acids may be used individually or as a mixture thereof.

The metal salt of the aromatic carboxylic acid is dispersed in an aqueous system mechanically using a ball mill, an attritor, a sand mill attritor, etc., to provide a coating liquid. In this case, the use of a dispersing agent and an inorganic pigment gives desirable effects such as an improvement in the dispersion efficiency and developing power.

Suitable inorganic pigments which can be used in this invention include the oxides, hydroxides, carbonates, silicates, etc., of polyvalent metals such as magnesium, aluminum, calcium, titanium, manganese, nickel, zinc, zirconium, molybdenum, tin, antimony, lead, etc. (e.g., zinc oxide, calcium oxide, titanium oxide, zinc hydroxide, magnesium hydroxide, calcium carbonate, aluminum silicate, etc.), kaolin, talc, active clay, etc. The amount of the inorganic pigment is preferably about 1 to about 1,000 parts by weight, more preferably 2 to 50 parts by weight, to the amount of the color developer.

The organic solvent which is used in this invention has a boiling point of about 150° C. to about 315° C. at normal pressure (760 mmHg) and dissolves the metal salt of the aromatic carboxylic acid in such an amount that the metal salt of the aromatic carboxylic acid has a solubility of 10 or more at 25° C., and of these solvents, organic solvents which have a boiling point of about 150° C. to about 315° C. (760 mmHg) and dissolve the metal salt of the aromatic carboxylic acid in such an amount that the metal salt of the aromatic carboxylic acid has a solubility of 30 or more at 25° C. are more preferred.

Exemplary organic solvents include aliphatic or aromatic esters, biphenyl derivatives, naphthalene derivatives, diphenylalkanes, etc., preferably diphenylalkanes. Specific examples of preferred organic solvents are methyl amyl acetate (or 1,3-dimethylbutyl acetate), 2-ethylbutyl acetate, 2-ethylhexyl acetate, amyl propionate, n-butyl butyrate, isobutyl isobutyrate, 2,2,4-trimethyl-1,3-pentanediol monoisobutyrate, 2,2,4-trimethyl-1,3-pentanediol diisobutyrate, 2,4-dimethyl-2,4-pentanediol diacetate, 2,2-dimethyl-1,3-butanediol diisobutyrate, 2-methyl-2,4-pentanediol dipropionate, 2,3,3,4-tetramethyl-2,4-pentanediol monoacetate, amyl lactate, 2-methylbiphenyl, 3-methylbiphenyl, 3,3-dimethylbiphenyl, 2,4-dimethylbiphenyl, 2,6-dimethylbiphenyl, 2,4,6-trimethylbiphenyl, cyclohexylbenzene, bicyclohexylbenzene, monoisopropylbiphenyl, monoisopropylnaphthalene, diisopropylnaphthalene, 1-isopropylphenyl-2-phenylethane, 1-isopropylphenyl-1-phenylethane, 1,1-ditolylethane, 1-ethylphenyl-1-phenylethane, 1-phenyl-1-xylylethane, etc.

The above solvent may also be used with a poor solvent having a boiling point of about 150° C. to about 315° C., such as a petroleum fraction, a paraffin series solvent (e.g., isooctane, etc.), etc., as a diluent, is desired.

The above-described organic solvent provides an aqueous emulsion using an ordinary emulsification dispersion method. For example, the organic solvent can be emulsified using a stirrer providing high shear, such as a homomixer, a homogenizer, a dissolver, etc., or a ultrasonic emulsifier, etc. In this case, an emulsifying agent which is generally used may be used if desired. Examples of suitable emulsifying agents are synthetic surface active agents such as a soap, a sulfuric acid ester sodium salt of a higher alcohol, sodium alkylbenzenesulfonate, etc.; gelatin, albumin, casein, gum arabic, tragacanth gum, alginates, carboxymethyl cellulose, saponin, polyvinyl alcohol, etc. The emulsifying agent which is used in this invention may be a material capable of emulsifying the organic solvent in a stable manner and hence there is no particular restriction as to the kind of emulsifying agent.

The amount of the emulsion of the organic solvent added to the coating liquid containing the metal salt of the aromatic carboxylic acid is about 0.1 to about 5 parts by weight, preferably 0.2 to 2.5 parts by weight, per part by weight of the metal salt of the aromatic carboxylic acid.

The coating liquid containing the metal salt of the aromatic carboxylic acid obtained as described above is mixed with an aqueous emulsion of the organic solvent also obtained as described above and after further adding thereto a binder, the resultant mixture is coated on a support.

Examples of binders which can be used in this invention are binders generally known in the field, for example, latexes such as a styrene-butadiene copolymer latex; synthetic or natural polymers such as polyvinyl alcohol, a maleic anhydride-styrene copolymer, starch, casein, gum arabic, gelatin, carboxymethyl cellulose, methyl cellulose, etc.

The ultimate amount or coverage of the color developer coated on a support in this invention is about 0.1 to about 3.0 g/m$^2$, preferably 0.2 to 1.0 g/m$^2$.

There is no particular restriction on color formers which react with the color developer sheets of this invention. Specific examples of these color formers are (1) triarylmethane compounds such as 3,3-bis(p-dimethylaminophenyl)-6-dimethylaminophthalide (Crystal Violet lactone), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, 3-p-dimethylaminophenyl-3-(1-methylpyrrole-2-yl)-6-dimethylaminophthalide, etc.; (2) diphenylmethane compounds such as 4,4'-bisdimethylaminobenzhydrin benzyl ether, N-halophenylleucoauramine, N-2,4,5-trichlorophenylleucoauramine, etc.; (3) xanthene compounds such as Rhodamine B anilinolactam, Rhodamine B p-nitroanilinolactam, Rhodamine B p-chloroanilinolactam, 7-dimethylamino-2-methoxyfluoran, 7-diethylamino-3-chlorofluoran, 7-diethylamino-3-chloro-2-methylfluoran, 7-diethylamino-2,2-dimethylfluoran, 7-diethylamino-3-acetylmethylaminofluoran, 7-diethylamino-3'-methylaminofluoran, 3,7-diethylaminofluoran, 7-diethylamino-3-dibenzylaminofluoran, 7-diethylamino-3-methylbenzylaminofluoran, 7-diethylamino-3-chloroethylmethylaminofluoran, 7-diethylamino-3-diethylaminofluoran, etc.; (4) thiazine compounds such as benzoylleucomethylene blue, p-nitrobenzoylleucomethylene blue, etc.; (5) spiro compounds such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiro-pyran, 3-propyl-spiro-dibenzopyran, etc. These color formers may be used individually or as a mixture thereof.

The color former is dissolved in a solvent followed by microcapsulation according to an ordinary manner and the microcapsule-containing liquid is coated on a support.

Solvents which can be used in this case include natural or synthetic oils, which can be used individually or as a mixture thereof. Examples of suitable solvents are cotton seed oil, kerosene, paraffin, naphthene oil, alkylated biphenyl, alkylated terphenyl, alkylated naphthalene, diarylethane, triarylmethane, chlorinated paraffin, etc.

The color former-containing microcapsules can be produced using an interfacial polymerization method, an internal polymerization method, a phase separation method, an external polymerization method, a coacervation method, etc. Then, appropriate additives such as a water-soluble binder, a latex binder, cellulose powders, starch particles, talc, etc., are mixed with the microcapsule liquid to provide a color former-containing microcapsule coating liquid. The preparations of the color former-containing microcapsule coating liquid are described in, for example, U.S. Pat. Nos. 3,993,831 and 4,297,235.

The properties of the pressure-sensitive recording color developer sheet of this invention were tested using the following color former-containing microcapsule sheet. Unless otherwise indicated herein, all parts, percents, ratios and the like are by weight.

Preparation of Color Former-Containing Microcapsule Sheet

In 95 parts of hot water at about 80° C. was dissolved 5 parts of the partial sodium salt of polyvinylbenzenesulfonic acid (VERSA TL 500, trade name, made by International Starch Co., mean molecular weight of 500,000) with stirring for about 30 minutes and then the solution was cooled. The pH of the aqueous solution thus obtained was 2 to 3 and the pH of the aqueous solution was adjusted to 4.0 by the addition of an aqueous solution of 20% by weight sodium hydroxide. Separately, 100 parts of diisopropylnaphthalene having dissolved therein 2.5% Crystal Violet lactone and 1.0% Benzoyl Leucomethylene Blue was dispersed by emulsification in 100 parts of the above-described 5% aqueous solution of the partial sodium salt of polyvinylbenzenesulfonic acid to provide an emulsion having a particle size mean diameter of 4.5μ. Additionally, a mixture of 6 parts of melamine, 11 parts of an aqueous solution of 37% by weight formaldehyde, and 30 parts of water was heated to 60° C. with stirring for 30 minutes to provide a transparent aqueous solution of a mixture of melamine, formaldehyde, and an initial condensation product of melamine and formaldehyde. The pH of the aqueous solution of the mixture was 6 to 8. Hereinafter, the aqueous solution of the mixture of melamine, formaldehyde, and an initial condensation product of melamine and formaldehyde is referred to as an initial condensate solution.

The initial condensate solution obtained by the above-described method was mixed with the above-described emulsion, the pH of the mixture was adjusted to 6.0 by the addition of an aqueous solution of 3.6% by weight hydrochloric acid with stirring and after increasing the liquid temperature to 65° C., the mixture was stirred for 360 minutes at the same temperature. The microcapsule liquid thus prepared was cooled to room temperature and the pH of the liquid was adjusted to 9.0 with an aqueous solution of 20% by weight sodium hydroxide.

To the microcapsule dispersion thus prepared were added 200 parts of an aqueous solution of 10% by weight polyvinyl alcohol and 50 parts of starch particles and then the solid component concentration of the mixture was adjusted to 20% by the addition of water to provide a color former-containing microcapsule coating liquid.

The coating liquid was coated on a base paper of a basis weight of 50 g/m$^2$ at 5 g/m$^2$, on a solid component basis by means of an air knife coater and dried to provide a color former-containing microcapsule sheet.

The following examples are given to explain the present invention in more detail but they are not intended to limit the present invention in any way.

EXAMPLE 1

To a solution of 10 parts of an aqueous solution of 2% polyvinyl alcohol (PVA-205, trade name, made by Kuraray Co., Ltd.) and 0.1 part of an aqueous solution of 10% sulfosuccinic acid was added 10 parts of 1-ethylphenyl-1-phenylethane and the mixture was stirred for 15 minutes with a homogenizer to provide an aqueous emulsion.

Then, 10 parts of zinc 3,5-di-α-methylbenzylsalicylate, 80 parts of aluminum hydroxide, 20 parts of zinc oxide, and 1 part of sodium hexametaphosphate were dispersed in 200 parts of water using a Kedy mill. The dispersion was further treated in a sand mill. The dispersion thus prepared was mixed with the above-described aqueous emulsion and after adding thereto 100 parts of an aqueous solution of 10% polyvinyl alcohol (PVA-110, made by Kuraray Co., Ltd.) and 10 parts (on a solids component basis) of a carboxy-modified SBR latex (SN-304, trade name, made by Sumitomo Nogatax Co.), the solid component concentration of the resultant mixture was adjusted to 20% by addition of water.

The coating liquid thus prepared was coated on a base paper of a basis weight of 50 g/m$^2$ at 5.5 g/m$^2$ on a solids component basis using air knife coating and dried to provide a color developer sheet.

EXAMPLE 2

By following the same procedures as described in Example 1 except that 1-phenyl-1-xylylethane was used in place of 1-ethylphenyl-1-phenylethane, a color developer sheet was obtained.

EXAMPLE 3

By following the same procedures as described in Example 1 except that monoisopropylbiphenol was used in place of 1-ethylphenyl-1-phenylethane, a color developer sheet was obtained.

COMPARISON EXAMPLE 1

In Example 1, a coating liquid without an aqueous emulsion was coated on a base paper at 50 g/m$^2$ on a solids components basis using an air knife coater and dried to provide a color developer sheet.

COMPARISON EXAMPLE 2

By following the same procedures as described in Example 1 except that ethyl acetate was used in place of 1-ethylphenyl-1-phenylethane, a color developer sheet was obtained.

COMPARISON EXAMPLE 3

By following the same procedures as described in Example 1 except that a fluid paraffin was used in place of 1-ethylphenyl-1-phenylethane, a color developer sheet was obtained.

COMPARISON EXAMPLE 4

By following the same procedures as described in Example 1 except that isooctane was used in place of 1-ethylphenyl-1-phenylethane, a color developer sheet was obtained.

Comparison of Properties

The properties of the color developer sheets obtained in the above-described examples were compared with those of the color developer sheets obtained in the above-described comparison examples as follows.

(1) Developing Power and Coloring Speed

The color former-containing microcapsule sheet was superposed on each of the color developer sheets obtained in the above-described examples and comparison examples with the coated layers in a face-to-face relationship and a load of 600 kg/cm$^2$ was applied thereto to cause coloring. The density of the colored image thus formed was measured at 610 nm using a Hitachi Color Analyzer Type 307, made by Hitachi, Ltd., after 15 sec., 5 min., and 1 day, respectively. The density ratio of the density after 15 sec./the density after 5 min. was employed as a measure of coloring speed and the density after 1 day was employed as a measure of developing power.

(2) Coating Unevenness of Coated Sheet

The unevenness of each of the color developer sheets (per m$^2$) obtained in the above-described examples and comparison examples was measured.

The results thus obtained are shown in Table 1 below.

TABLE 1

| Sample | Organic Solvent | Boiling Point (°C.) | Solubility* | Developing Power | Coloring Speed | Uneveness of Coated Sheet |
|---|---|---|---|---|---|---|
| Example 1 | 1-Ethylphenyl-1-phenylethane | 310 | A | 1.01 | 0.90 | 0 |
| Example 2 | 1-Phenyl-1-xylylethane | 303 | A | 1.00 | 0.91 | 0 |
| Example 3 | Monoiospropylbiphenyl | 300 | A | 1.00 | 0.89 | 1 |
| Comparison Example 1 | None | | — | 0.87 | 0.66 | 13 |
| Comparison Example 2 | Ethyl acetate | 77 | A | 0.88 | 0.70 | 3 |
| Comparison Example 3 | Fluid paraffin | >315 | B | 0.87 | 0.67 | 1 |
| Comparison Example 4 | Isooctane | 90 | B | 0.86 | 0.66 | 3 |

*Solubility of zinc 3,5-bis-α-methylbenzylsalicylate:
A: 10 or more
B: lower than 10

As is shown by the results in Table 1 above, it can be seen that the color developer sheets produced by the process of this invention are satisfactory in all of the properties of developing power, coloring speed, and unevenness of coated sheet.

While the invention has been described in detail and with reference to specific embodiments thereof, it will be apparent to one skilled in the art that various changes and modifications can be made therein without departing from the spirit and scope thereof.

What is claimed is:

1. A process for producing a color developer sheet for pressure-sensitive recording comprising mixing a coating liquid containing a metal salt of an aromatic carboxylic acid and an aqueous emulsion of an organic solvent and coating the resulting mixture on a support, wherein the organic solvent is a biphenyl derivative or a diphenylalkane having a boiling point of about 150° C. to about 315° C. and dissolves the metal salt of the aromatic carboxylic acid in such an amount that the metal salt of the aromatic carboxylic acid has a solubility in the organic solvent of 10 or more at 25° C.

2. The process of producing a developer sheet for pressure-sensitive recording as claimed in claim 1, wherein the aromatic carboxylic acid is a salicylic acid derivative.

3. The process of producing a developer sheet for pressure-sensitive recording as claimed in claim 2, wherein the metal salt of the salicylic acid derivative is the zinc salt thereof.

4. A process for producing a developer sheet for pressure-sensitive recording as claimed in claim 2, wherein said salicylic acid derivative has a substituent selected from the group consisting of an alkyl group, an aryl group and an aralkyl group at at least one of the ortho position and para position to the hydroxy group.

5. A process for producing a developer sheet for pressure-sensitive recording as claimed in claim 4, wherein said substituent to said salicylic acid derivative contains 8 or more carbon atoms.

6. A process for producing a developer sheet for pressure-sensitive recording as claimed in claim 1, wherein the aromatic carboxylic acid metal salt has a hydroxy group at the ortho position or the para position to the carboxy group.

7. A process for producing a developer sheet for pressure-sensitive recording as claimed in claim 1, when the metal of the aromatic carboxylic acid metal salt is selected from the group consisting of magnesium, aluminum, calcium, nickel, copper, zinc, tin and lead.

8. A process for producing a developer sheet for pressure-sensitive recording as claimed in claim 1, wherein the amount of the emulsion of the organic solvent added to the coating liquid containing the metal salt of the aromatic carboxylic acid is about 0.1 to about 5 parts by weight per part by weight of the metal salt of the aromatic carboxylic acid.

9. A process for producing a developer sheet for pressure-sensitive recording as claimed in claim 1, wherein the amount of the emulsion of the organic solvent added to the coating liquid containing the metal salt of the aromatic carboxylic acid is about 0.2 to 2.5 parts by weight per part by weight of the metal salt of the aromatic carboxylic acid.

10. A process for producing a developer sheet for pressure-sensitive recording as claimed in claim 1, further comprising mixing a binder with the liquid containing the metal salt of the aromatic carboxylic acid and aqueous emulsion of the organic solvent.

11. A process for producing a developer sheet for pressure-sensitive recording as claimed in claim 1, wherein the organic solvent is a diphenylalkane.

12. A process for producing a developer sheet for pressure-sensitive recording as claimed in claim 1, wherein the organic solvent is a biphenyl derivative.

* * * * *